US008066340B2

(12) United States Patent
Bielecki

(10) Patent No.: US 8,066,340 B2
(45) Date of Patent: Nov. 29, 2011

(54) ORGANIZER/STORAGE SYSTEM THAT MOUNTS ON TOP OF A COMPUTER WORKSTATION

(76) Inventor: Pavel Bielecki, Monterey, CA (US)

( * ) Notice: Subject to any disclaimer, the term of this patent is extended or adjusted under 35 U.S.C. 154(b) by 127 days.

(21) Appl. No.: 12/590,792

(22) Filed: Nov. 13, 2009

(65) Prior Publication Data

US 2011/0115346 A1 May 19, 2011

(51) Int. Cl.
*A47B 47/00* (2006.01)

(52) U.S. Cl. ..... 312/259; 211/86.01; 211/135; 312/281

(58) Field of Classification Search ..... 312/223.2, 312/258, 259, 280, 281; 211/72, 73, 70.1, 211/86.01, 113, 10, 184, 135; 248/205.5, 248/152, 174, 459; 229/120.32, 120.34, 229/198.2; 220/62
See application file for complete search history.

(56) References Cited

U.S. PATENT DOCUMENTS 1,994,400 A * 3/1935 Mulford ..... 47/84
2,043,483 A * 6/1936 Lynch ..... 248/174
2,648,482 A * 8/1953 Belsinger ..... 229/120.18
2,990,995 A * 7/1961 Wessel ..... 206/510
3,269,638 A * 8/1966 Forbes ..... 229/152
3,279,873 A * 10/1966 Gronquist ..... 312/259
3,360,180 A * 12/1967 Venturi ..... 220/7
3,508,734 A * 4/1970 Thomas ..... 248/459
3,656,611 A * 4/1972 Mertz ..... 206/764
3,749,299 A * 7/1973 Ingle ..... 229/120.34
3,862,785 A 1/1975 Scheerhorn et al.
3,957,320 A * 5/1976 Walter ..... 312/108
4,739,921 A * 4/1988 Taub ..... 229/120.32
4,936,228 A 6/1990 Capo-Bianco
5,193,466 A * 3/1993 Eder ..... 108/166
5,209,443 A * 5/1993 Maddox ..... 248/165
5,213,220 A * 5/1993 McBride ..... 211/132.1
D366,165 S 1/1996 Holsinger et al.
5,628,255 A 5/1997 Neuner
5,632,390 A * 5/1997 Podergois ..... 211/195
(Continued)

OTHER PUBLICATIONS

PCT International Search Report and Written Opinion; International Application No. PCT/US2010/047787; Dated May 17, 2011; 16 Pages; International Searching Authority/ European Patent Office, Rijswijk, The Netherlands.

*Primary Examiner* — Darnell Jayne
*Assistant Examiner* — Hiwot Tefera
(74) *Attorney, Agent, or Firm* — The Law Offices of Andrew D. Fortney; Andrew D. Fortney; Sherrie M. Flynn

(57) ABSTRACT

An organizer/storage system that mounts on top of a computer workstation for storage of office supplies, devices, or files that makes efficient use of the available space above, or on one or both sides of the computer workstation. The organizer/storage system includes a top platform and side panels, and may include back and bottom panels with interlocking closure systems, and slide-in shelves with optional drawers. Optional cutouts in the side panels allow airflow to cool the computer, and optional cutouts in the back panels permit connection of conduit or electrical wires. When adaptive fasteners are used for attachment to the computer workstation, the height of the organizer/storage system may be adjusted. Exterior side shelves may be attached to one or both of the side panels to permit storage of a greater variety of objects. The organizer/storage system may be made from a single sheet of suitable material.

19 Claims, 9 Drawing Sheets

U.S. PATENT DOCUMENTS

| | | | | |
|---|---|---|---|---|
| D386,015 | S | 11/1997 | O'Sullivan et al. | |
| 5,865,125 | A | 2/1999 | Alexander et al. | |
| 5,873,516 | A * | 2/1999 | Boggs | 229/120.32 |
| 5,893,462 | A * | 4/1999 | Ridgeway | 206/583 |
| 5,996,786 | A * | 12/1999 | McGrath | 206/308.1 |
| 6,068,140 | A * | 5/2000 | Mangrum et al. | 211/132.1 |
| 6,126,254 | A * | 10/2000 | Maglione | 312/259 |
| 6,152,311 | A * | 11/2000 | German | 211/86.01 |
| 6,158,829 | A | 12/2000 | Nielsen | |
| 6,202,874 | B1 * | 3/2001 | Diamond | 220/4.03 |
| 6,273,531 | B1 | 8/2001 | Scheffer | |
| 6,283,564 | B1 | 9/2001 | Corson | |
| 6,343,008 | B1 | 1/2002 | Herto et al. | |
| 6,382,433 | B1 * | 5/2002 | Podergois | 211/195 |
| 6,389,992 | B1 | 5/2002 | Miller | |
| 6,533,165 | B2 * | 3/2003 | Giblin et al. | 229/183 |
| 6,666,347 | B1 * | 12/2003 | Diamond | 220/4.03 |
| 6,752,280 | B2 * | 6/2004 | Dye | 211/149 |
| 6,783,197 | B1 | 8/2004 | Balogh | |
| 7,165,687 | B1 | 1/2007 | Stevens et al. | |
| 7,216,772 | B2 * | 5/2007 | Moss et al. | 211/72 |
| 7,472,969 | B2 * | 1/2009 | Saravis | 312/111 |
| 7,475,777 | B2 * | 1/2009 | Fung et al. | 206/427 |
| 2002/0070134 | A1 | 6/2002 | Williams | |
| 2002/0095890 | A1 | 7/2002 | Brauning | |
| 2004/0140739 | A1 * | 7/2004 | Saravis | 312/111 |
| 2004/0155562 | A1 | 8/2004 | Saravis | |
| 2008/0000789 | A1 * | 1/2008 | Cheng et al. | 206/320 |
| 2008/0169340 | A1 * | 7/2008 | Sheffer | 229/120.32 |

* cited by examiner

ORGANIZER/STORAGE SYSTEM THAT MOUNTS ON TOP OF A COMPUTER WORKSTATION

TECHNICAL FIELD OF THE INVENTION

The invention relates to storage systems, and more particularly to lightweight, portable organizer/storage systems mountable on top of a computer workstation.

BACKGROUND OF THE INVENTION

The invention is an organizer/storage system that easily mounts on top of a computer workstation, and is lightweight and portable. Prior to the invention, the space immediately above a computer workstation was typically not utilized, or used for display and storage of only a small number of items that could be placed directly on top of the workstation. As a result, the space on top of the computer workstation was not utilized at all for storage of office supplies, devices, or files, or not used economically. Because today's busy and crowded office or home environment demands the efficient use of all available space, the top of a computer workstation is an area where gains in storage capacity and efficiency may be realized. Additionally, because office occupants frequently move the locations of their computer workstations or change arrangement of office spaces, it is important that any such storage system be lightweight and portable.

The inventor is not aware of any attempts to utilize the space above a computer workstation for supplementary storage of office files or for shelving systems. The inventor is aware of apparatus related to office and computer workstations, and lightweight storage systems, but none of these apparatus or systems utilize the storage space above the computer workstation. See, for example, such apparatus as the Modular Office Workstation by Capo-Bianco (U.S. Pat. No. 4,936,228); Portable, Wooden Computer Desk by Corson (U.S. Pat. No. 6,283,564 B1); Computer Keyboard Enclosure with Work Surface by Nielsen (U.S. Pat. No. 6,158,829); Computer Work Station by Alexander, et al. (U.S. Pat. No. 5,865,125); and Storage System Made of Cardboard by Balogh (U.S. Pat. No. 6,783,195).

For the foregoing reasons, there is a need for an organizer/storage system that mounts on top of a computer workstation that is lightweight and portable, and makes efficient use of this space for additional storage capacity.

SUMMARY OF THE INVENTION

To meet this and other needs, and in view of its purposes, the present invention provides an organizer/storage system that mounts on top of a computer workstation that is portable and lightweight and utilizes the unused space on top of the computer workstation. Alternatively, the organizer/storage system may also permit unused space adjacent to one or both sides of a computer workstation to be utilized efficiently.

An organizer/storage system that mounts on top of a computer workstation having the features of the present invention comprises a top platform that may sit directly on the top of the computer workstation or may sit at a distance above the top of the computer workstation, and serves to store or display items. The top platform is approximately as wide as the width of a computer workstation and is attached to first and second side panels at their upper edges. The first and second side panels extend vertically downward from the top platform to a height below the top of the workstation. A non-slip surface material may be adhered to the top platform for better grip of items placed on it.

The portions of the first and second side panels that extend below the top of the workstation serve to secure the storage system to the sides of the workstation, prevent lateral movement and prevent the organizer/storage system from tipping over. The first and second side panels may be mounted to the sides of the computer workstation by double-sided adhesive pads or other types of fasteners for secure attachment, and to enhance the overall stability and rigidity of the storage system. Alternatively, the first and second side panels may be attached to the sides of the computer workstation by adaptive fasteners such as Velcro® fasteners, to permit the height that the storage system sits above the top of the computer workstation to be adjusted. The portions of the first and second side panels that extend below the top of the computer workstation may have one or more cutouts to permit air ventilation to the computer workstation. Alternatively, and to provide maximum air ventilation to the computer workstation, the first and second side panels may truncate at the top of the computer workstation and may be secured to the sides of the workstation by wire clips.

When the organizer/storage system is arranged so that the top platform sits a distance above the top of the computer workstation, a top platform support panel provides additional rigidity and support to the top platform. The space defined by the top platform, the first and second side panels, and the top of the computer workstation may be divided for better utility into a plurality of slide-in shelves. The slide-in shelves are supported at their lateral edges by the upper edges of pairs of vertically oriented shelf support panels that are inside and adjacent to the first and second side panels, and are attached to the first and second side panels. Optional drawers may be placed on one or more of the shelves. In this embodiment of the invention, right and left back panels serve to provide lateral rigidity and enclose the back of the shelves and/or drawer spaces that provide the storage. The right and left back panels may contain one or more conduit cutouts for conduits and/or electrical wires that may be part of the computer workstation or that may be part of devices stored in the organizer/storage system. Right and left bottom panels serve to enclose the top of the workstation and further support and enhance the lateral rigidity of the organizer/storage system. The right and left back panels and right and left bottom panels may be provided with an interlocking closure system.

When the top platform of the organizer/storage system sits directly on top of the computer workstation, the organizer/storage system may have a plurality of exterior side shelves, in varying numbers and arrangements attached to one or both of the first and second exterior side panels. This embodiment of the invention permits more rigid shelves to be utilized on which heavier objects may be placed. An arrangement with all of the exterior side shelves attached to only one of the first and second side panels of the organizer/storage system permits the opposite side to be located directly against a desk or another item of furniture while efficiently utilizing the space opposite to the desk or other item of furniture for storage.

BRIEF DESCRIPTION OF THE DRAWINGS

The invention is best understood from the following detailed description when read in connection with the accompanying drawings. It is emphasized that, according to common practice, the various features of the drawings are not to scale. Instead, the dimensions of various features are expanded or reduced for clarity. Included in the drawings are the following figures.

DETAILED DESCRIPTION OF THE INVENTION

The invention will be described in connection with an organizer/storage system that mounts on the top of a computer workstation having a top platform located at a distance above the computer workstation, having two slide-in shelves and one drawer, and constructed of cardboard. The invention will be described with right and left back panels and right and left bottom panels having an interlocking closure system, and the top platform having an optional non-slip surface adhered to it. Optional conduit cutouts for conduit and/or wires are provided in the right and left back panels, and the organizer/storage system is attached to the computer workstation by double-sided adhesive pads. Although described in this manner, the invention is equally applicable to other materials of construction, closure systems, numbers and arrangements of drawers and shelves, and mechanisms of attachment to the computer workstation.

Figure 1:
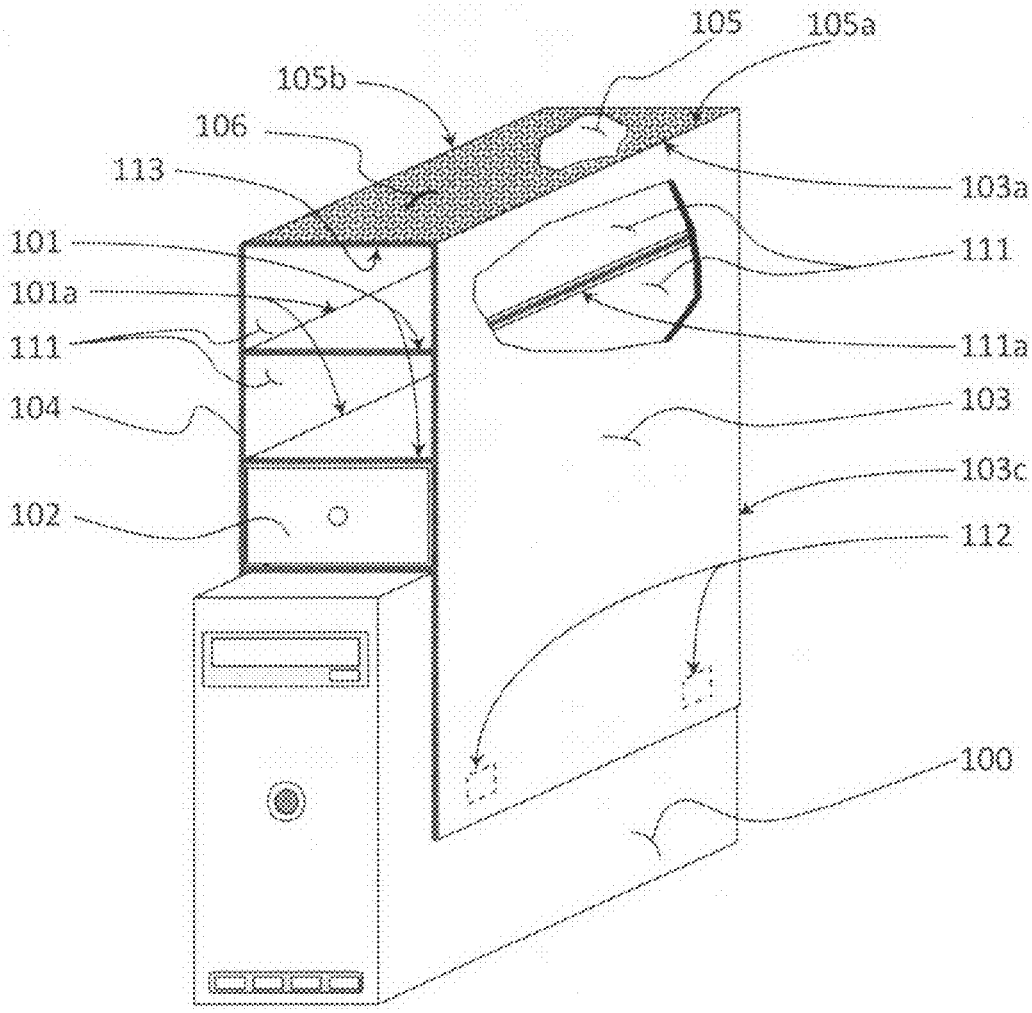
FIG. 1 is a partially cut away perspective view of the organizer/storage system that mounts on top of a computer workstation showing an embodiment of the invention with a top platform located at a distance above the computer workstation and attached to first and second side panels at its lateral edges.

Referring now to the drawing, in which like reference numbers refer to like elements throughout the various figures that comprise the drawing, FIG. 1 shows an embodiment of the invention with a top platform located at a distance above the computer workstation and attached to first and second side panels at its lateral edges. The particular organizer/storage system shown includes two slide-in shelves and an optional drawer, and an optional non-slip surface on top of the organizer/storage system. The organizer/storage system is attached to the sides of the computer workstation by double-sided adhesive pads. The slide-in shelves and top platform are supported at their lateral edges by pairs of vertically oriented shelf support panels, and a top platform support panel designed to fit horizontally underneath the top platform provides additional rigidity and support to the top platform.

Figure 2:
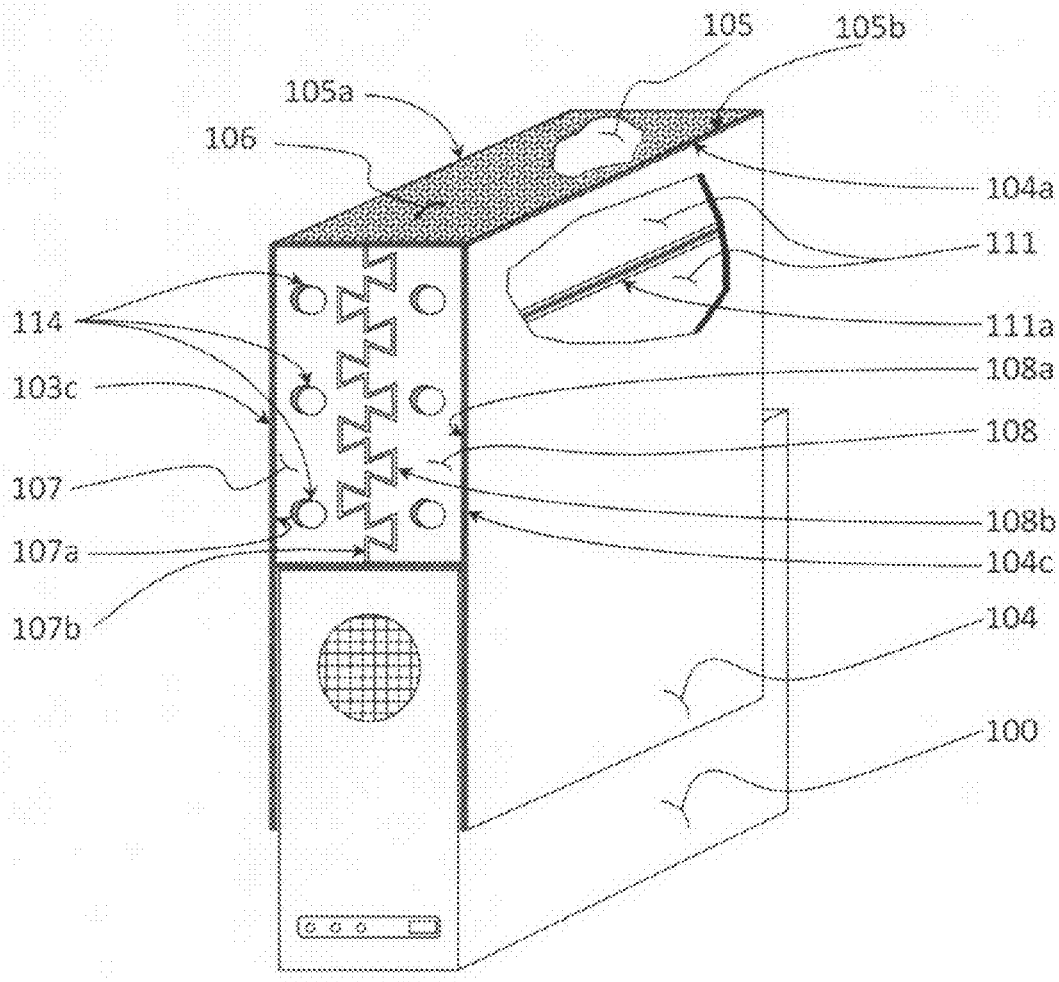
FIG. 2 is a partially cut away rear perspective view of the organizer/storage system of FIG. 1, showing an embodiment of the invention wherein the right and left back panels have an interlocking closure system, and optional conduit cutouts for electrical cords or conduits (not shown)
Figure 3:
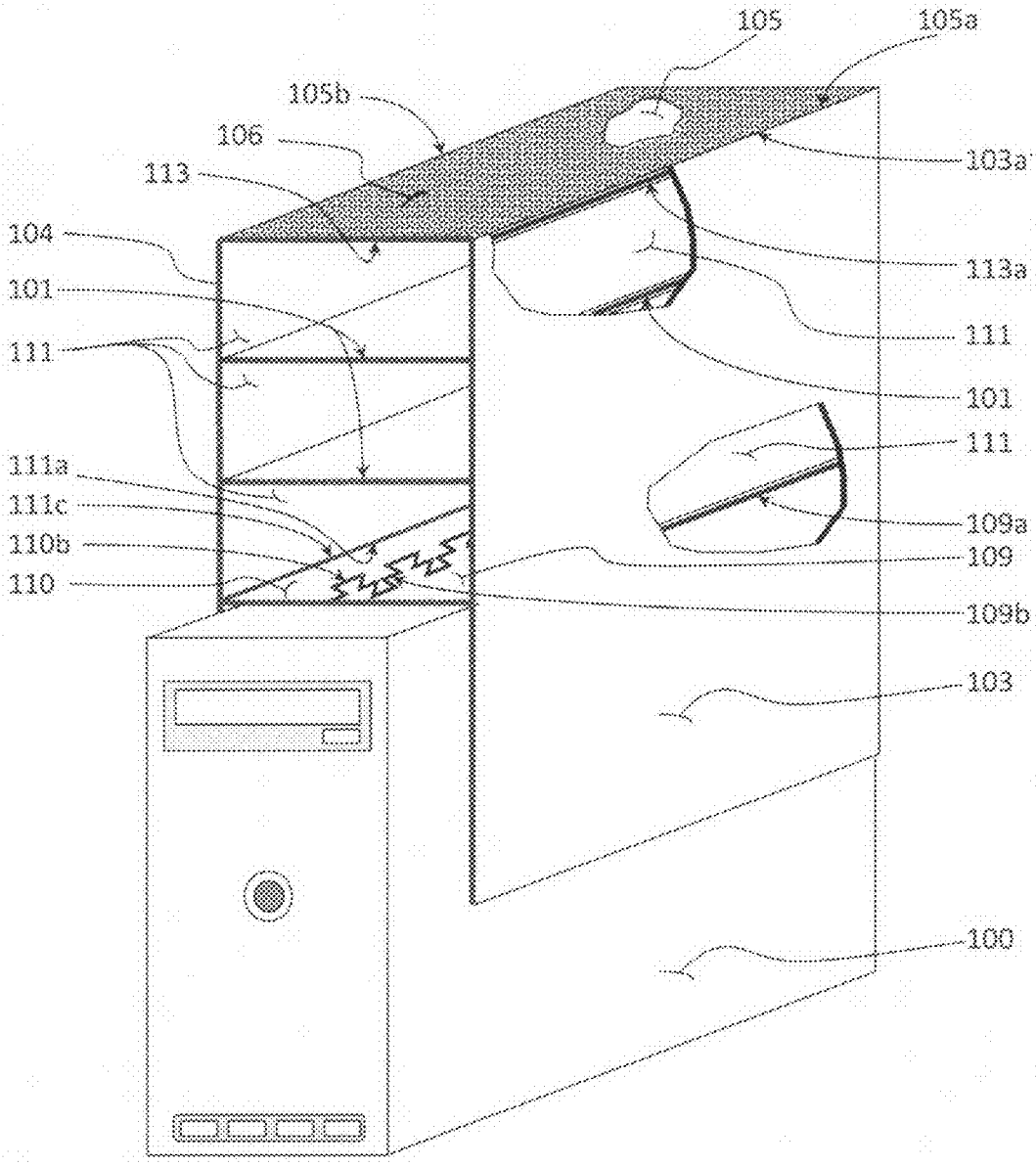
FIG. 3 is a perspective view of a portion of the organizer/storage system of FIG. 1, with the optional drawer removed, showing an embodiment of the invention wherein the right and left bottom panels have an interlocking closures system.

Referring to FIGS. 1-3, an organizer/storage system for mounting on top of a computer workstation 100 having a top platform located at a distance above the computer workstation 100 and having two slide-in shelves 101 and one drawer 102 comprises a top platform 105, oriented generally horizontally, and having a width approximately as wide as the width of the computer workstation 100, having a right lateral edge 105*a*, and a left lateral edge 105*b*. A first side panel 103 and a second side panel 104, oriented generally vertically and mutually parallel, are spaced apart at a distance approximately equal to the width of the top platform 105. The upper edge 103*a* of the first side panel 103 is attached to the top platform 105 at its right lateral edge 105*a*, and the upper edge 104*a* of the second side panel 104 is attached to the top platform 105 at its left lateral edge 105*b*.

A top platform support panel 113 having a width designed to fit underneath the top platform 105 and between the first and second side panels 103, 104, is attached to the top platform 105 and gives the top platform 105 extra rigidity and support.

Three pairs of shelf support panels 111, with each support panel of a pair oriented generally vertically and mutually parallel and spaced apart from its counterpart at a distance approximately equal to the distance between the first and second side panels 103, 104, are designed to fit inside and adjacent to the first and second side panels and are arranged in a vertically stacked relationship so that the upper edges 111*a* of each pair of shelf support panels 111 below the uppermost pair holds one slide-in shelf 101 at its lateral edges 101*a*, the upper edges 111*a* of the uppermost pair of shelf support panels 111 holds the top platform support panel 113 at its laterals edge 113*a*, and the bottommost pair of support panels 111 have bottom edges 111*c*. Three shelf support panels of each of the three pairs of shelf support panels 111 are attached to the first side panel 103, and the other three shelf support panels of each of the three pairs of shelf support panels 111 are attached to the second side panel 104.

In the preferred embodiment of the invention, the organizer/storage system is attached to the computer workstation 100 by double-sided adhesive pads 112, and an optional non-slip surface 106 is affixed to the top platform 105 to prevent objects stored on the top platform 105 from slipping off the organizer/storage system.

The organizer/storage system for mounting on top of a computer workstation 100 having a top platform 105 located at a distance above the computer workstation 100 and having two slide-in shelves 101 and one drawer 102, also comprises a right back panel 107, with a right edge 107*a* and a left edge 107*b*, and a left back panel 108 with a left edge 108*a* and a right edge 108*b*. The right edge 107*a* of the right back panel 107 is pivotally attached to the first side panel 103 at its rear edge 103*c*, and the left edge 108*a* of the left back panel 108 is pivotally attached to the second side panel 104 at its rear edge 104*c*. In the preferred embodiment of the invention, the left edge 107*b* of the right back panel 107 and the right edge 108*b* of the left back panel 108 include an interlocking closure system for closing in the back of the organizer/storage system and for providing structural rigidity. Also, the preferred embodiment of the invention includes optional conduit cutouts 114 for conduits and/or electrical wires (not shown) that may be part of the computer workstation 100 or part of devices stored in the organizer/storage system.

The organizer/storage system for mounting on top of a computer workstation 100 having a top platform 105 located at a distance above the computer workstation 100 and having two slide-in shelves 101 and one drawer 102, also comprises a right bottom panel 109, with a right edge 109*a* and a left edge 109*b*, and a left bottom panel 110 with a left edge 110*a* and a right edge 110*b*. The right edge 109*a* of the right bottom panel 109 is pivotally attached to the bottom edge 111*c* of one of the shelf support panels of the bottommost pair of shelf support panels 111, and the left edge 110*a* of the left bottom panel 110 is pivotally attached to the bottom edge 111*c* of the other shelf support panel of the bottommost pair of shelf support panels 111. In the preferred embodiment of the invention, the left edge 109*b* of the right bottom panel 109 and the right edge 110*b* of the left bottom panel 110 include an interlocking closure system for closing in the top of the computer workstation 100 and for providing structural rigidity for assembly and for forming a rigid bottom support for the organizer/storage system.

Figure 4:
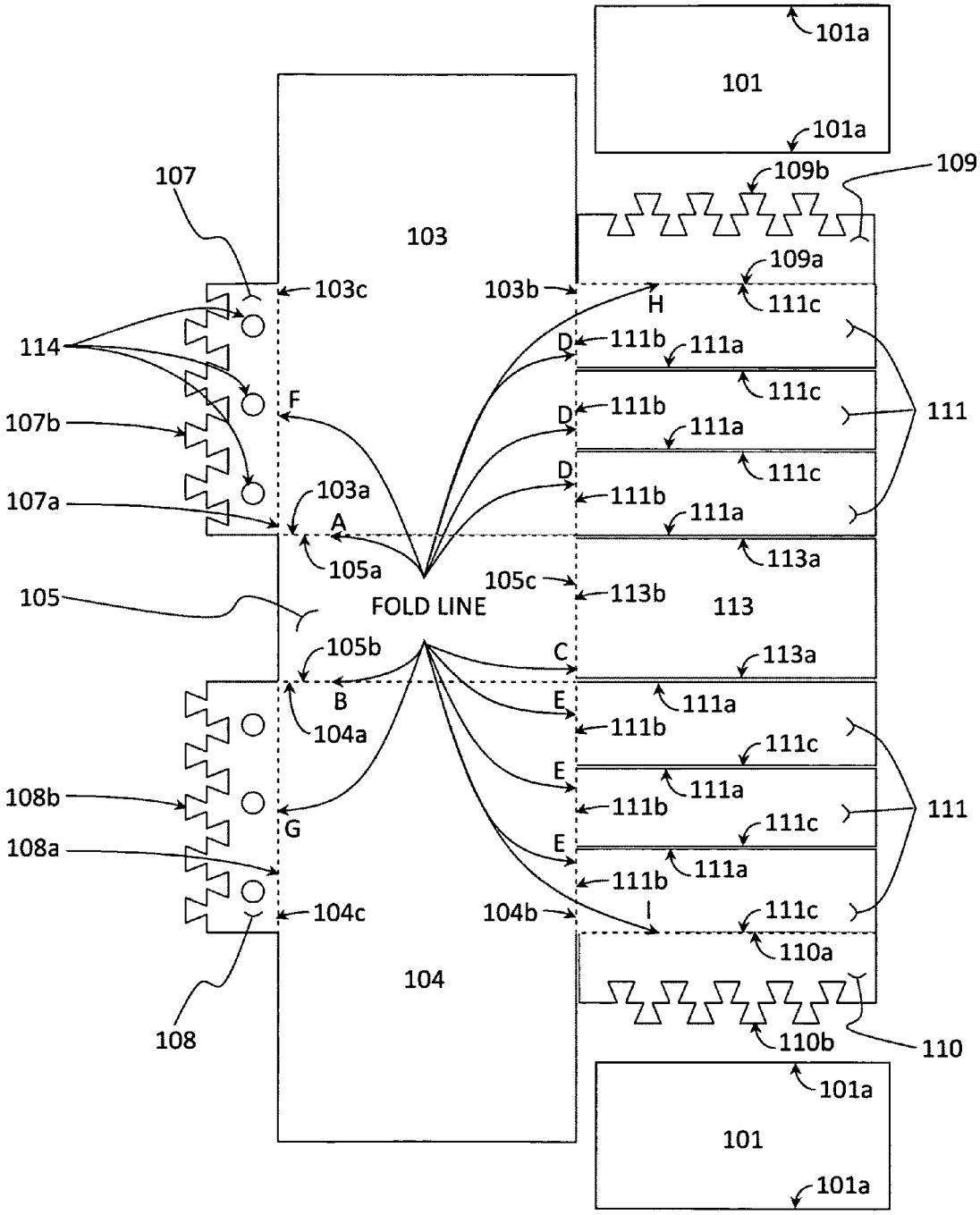
FIG. 4 is a pattern for making the organizer/storage system of FIG. 1 from a single sheet of suitable sheet material.

Referring to FIG. 4, there is shown a pattern for making an organizer/storage system comprising two slide-in shelves 101 from a single piece of cardboard or other suitable material such as thin gauge sheet metal. Up to three optional drawers 102 (not shown) made from separate pieces of cardboard or other suitable material may be added to the organizer/storage system made from the pattern shown in FIG. 4. The optional non-slip surface 106 (not shown) is made from separate non-slip material.

As shown in FIG. 4, the pattern comprises a top platform 105, having a width approximately. as wide as the width of the computer workstation 100, having a right lateral edge 105*a*, a left lateral edge 105*b*, and a front edge 105*c*, the front edge 105*c* oriented substantially perpendicular to the right lateral edge 105*a* and the left lateral edge 105*b*. When the organizer/storage system is cut out and assembled from the pattern of FIG. 4, and mounted on top of computer workstation 100 (not shown), the top platform 105 will be oriented generally horizontally and located at a distance above the top of computer workstation 100.

The first side panel 103, having an upper edge 103*a* , a front edge 103*b*, and a rear edge 103*c* is arranged so that the upper edge 103*a* of the side panel 103 and the right lateral edge 105*a* of the top platform 105 define a fold line A. When the organizer/storage system is cut out and assembled from the pattern of FIG. 4 and folded substantially 90 degrees at fold line A, the first side panel 103 will be oriented vertically, and generally perpendicularly to top platform 105.

The second side panel 104, having an upper edge 104*a*, a front edge 104*b*, and a rear edge 104*c* is arranged so that the upper edge 104*a* of the side panel 104 and the left lateral edge 105*b* of the top platform 105 define a fold line B. When the organizer/storage system is cut out and assembled from the pattern of FIG. 4, and folded substantially 90 degrees at fold line B, the second side panel 104 will be oriented vertically, and generally perpendicularly to top platform 105 and mutually parallel to first side panel 103, and spaced apart at a distance approximately equal to the width of the top platform 105.

The top platform support panel 113, having two lateral edges 113*a* and a rear edge 113*b*, is arranged so that the rear edge 113*b* and the front edge 105*c* of the top platform 105 define a fold line C. When the organizer/storage system is cut out and assembled from the pattern of FIG. 4 and folded substantially 180 degrees at fold line C, the top platform support panel 113 will be oriented horizontally underneath the top platform 105 so as to give the top platform 105 extra strength and rigidity.

Three pairs of shelf support panels 111, with each shelf support panel of a pair having an upper edge 111*a*, a rear edge 111*b*, and a bottom edge 111*c*, are arranged so that the rear edges 111*b* of three of the shelf support panels of the shelf support panel pairs 111 and three segments of the front edge 103*b* of the side panel 103 define three fold lines D, and the rear edges 111*b* of the other three shelf support panels of the shelf support panel pairs 111 and three segments of the front edge 104*b* of the second side panel 104 define three fold lines E. Each pair of shelf support panels 111 are arranged so that when the organizer/storage system is cut out and assembled from the pattern of FIG. 4 and folded 180 degrees along the three fold lines D and the three fold lines E, the pairs of shelf support panels 111 are oriented generally vertically, and arranged in a vertically stacked relationship so that the upper edges 111*a* of the uppermost pair of shelf support panels 111 hold the top platform support panel 113 at its lateral edges 113*a*, and the other two pairs of shelf support panels 111 each hold one slide-in shelf 101 at its lateral edges 101*a*.

The right back panel 107, having a right edge 107*a* and a left edge 107*b*, is arranged so that the right edge 107*a* and a segment of the rear edge 103*c* of the first side panel 103 define a fold line F. When the organizer/storage system is cut out and assembled from the pattern of FIG. 4 and folded substantially 90 degrees at fold line F, the right back panel 107 is oriented vertically. The left back panel 108, having a left edge 108*a* and a right edge 108*b*, is arranged so that the left edge 108*a* and a segment of the rear edge 104*c* of the second side panel 104 define a fold line G. When the organizer/storage system is cut out and assembled from the pattern of FIG. 4 and folded substantially 90 degrees at fold line G, the left back panel 108 is oriented vertically and the left edge 107*b* of the right back panel 107 will adjoin and interlock with the right edge 108*b* of the left back panel 108.

The pattern of FIG. 4 is also shown with optional conduit cutouts 114 in the right back panel 107 and the left back panel 108.

The right bottom panel 109, having a right edge 109*a* and a left edge 109*b*, is arranged so that the right edge 109*a* and the bottom edge 111*c* of one of the shelf support panels of a pair of shelf support panels 111 define a fold line H. When the organizer/storage system is cut out and assembled from the pattern of FIG. 4 and folded substantially 90 degrees at fold line H, the right bottom panel 109 is oriented horizontally. The left bottom panel 110, having a left edge 110*a* and a right edge 110*b*, is arranged so that the left edge 110*a* and the bottom edge 111*c* of one of the shelf support panels of a pair of shelf support panels 111 define a fold line I. When the organizer/storage system is cut out and assembled from the pattern of FIG. 4 and folded substantially 90 degrees at fold line I, the left bottom panel 110 is oriented horizontally and the left edge 109*b* of the right bottom panel 109 will adjoin and interlock with the right edge 110*b* of the left bottom panel 110.

The pattern of FIG. 4 provides a simple and efficient method of making and assembling the organizer/storage system without the need for separate fasteners to attach the different components. The organizer/storage system made from the pattern of FIG. 4 is also easily disassembled for transportation and storage, and can be quickly reassembled.

Figure 5A:
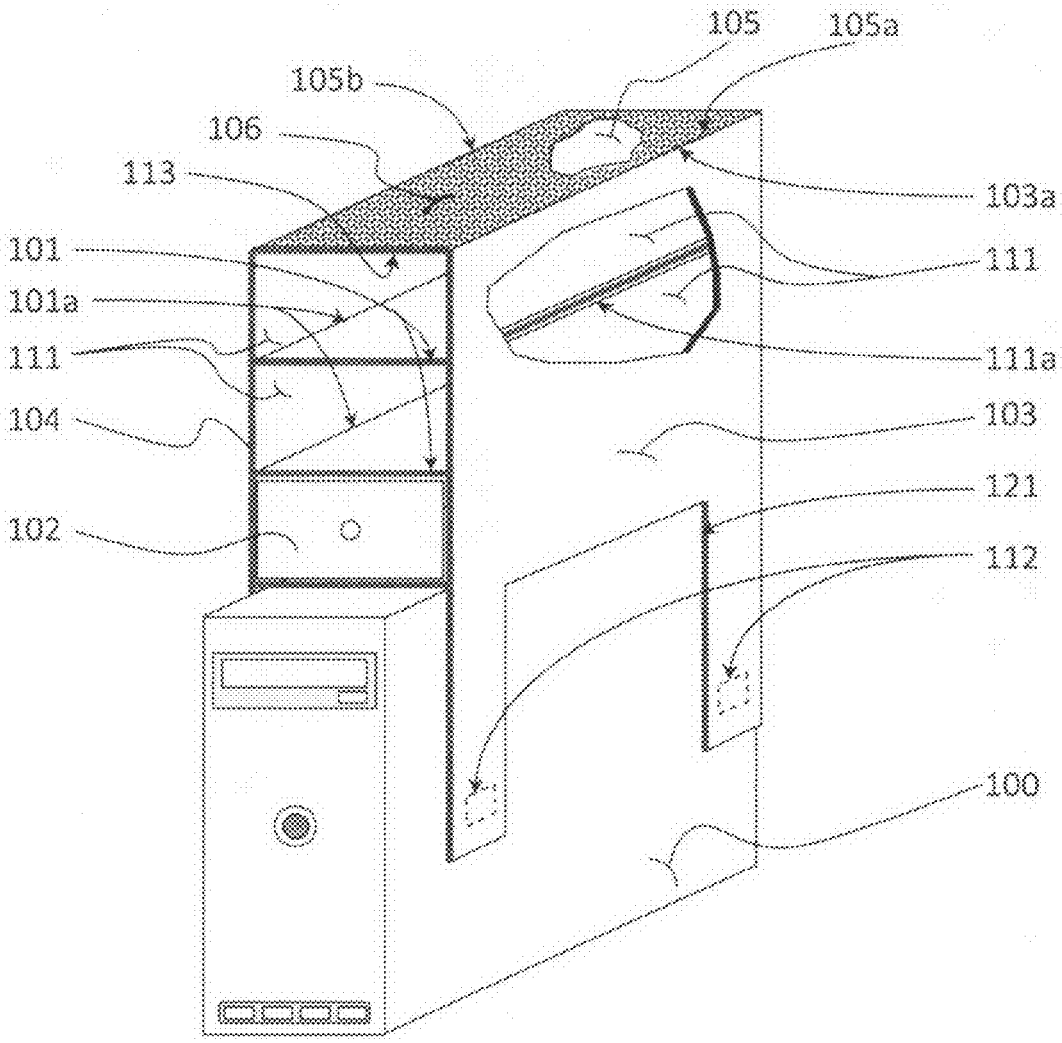
FIG. 5A is a perspective view of the organizer/storage system of FIG. 1, showing the first panels with one cutout.

Referring to FIG. 5A, there is shown separately an embodiment of the invention comprising an organizer/storage system having a first side panel 103 with a side panel cutout 121 to allow for airflow to cool the computer workstation 100. Although the cutout 121 is shown to be rectangular, other shapes and numbers of cutouts may also be used. One or both of the side panels 103, 104 may have the side panel cutout 121. The organizer/storage system with side panel cutouts 121 may also be made of cardboard, utilize the interlocking closure system and the same two slide-in shelves 101 and one drawer 102, and be attached with double-sided adhesive pads 112 as in the preferred embodiment of the invention, but is equally applicable to other materials of construction, closure systems, arrangements of drawers and shelves, and attachment methods.

Figure 5B:
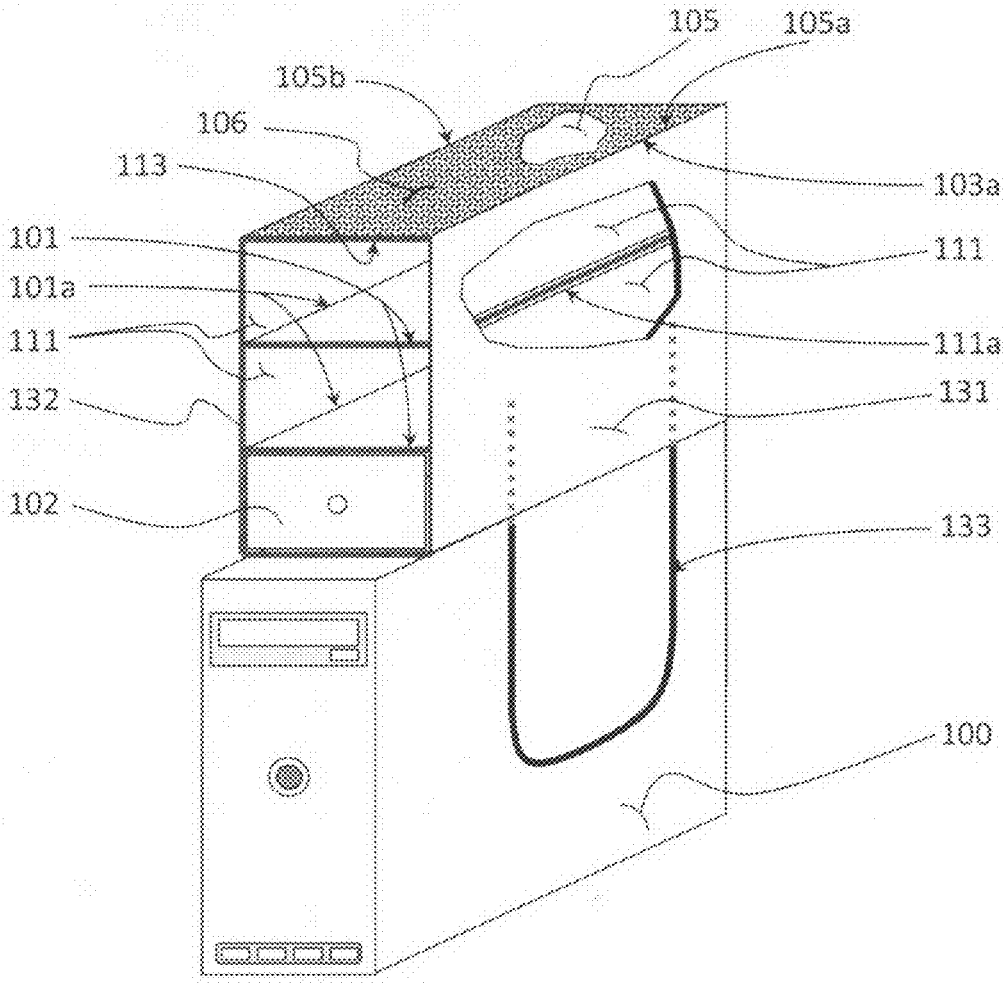
FIG. 5B is a perspective view of the organizer/storage system of FIG. 1, showing another embodiment of the organizer/storage system with truncated first and second side panels attached to the computer workstation by wire clips.

Referring to FIG. 5B, there is shown separately an embodiment of the invention comprising an organizer/storage system wherein the first side panel 131 and the second side panel 132 extend down vertically from the top platform 105 and truncate near the top of the computer workstation 100, and are attached to the computer workstation 100 by clips 133 preferably made of wire. The organizer/storage system with the clips 133 may also be made of cardboard and utilize the interlocking closure system and the same two slide-in shelves 101 and one drawer 102 as in the preferred embodiment of the invention, but is equally applicable to other materials of construction, closure systems, and arrangements of drawers and shelves. The clips 133 allow for airflow to cool the computer workstation 100 while providing a rigid support for the organizer/storage system.

Figure 6:
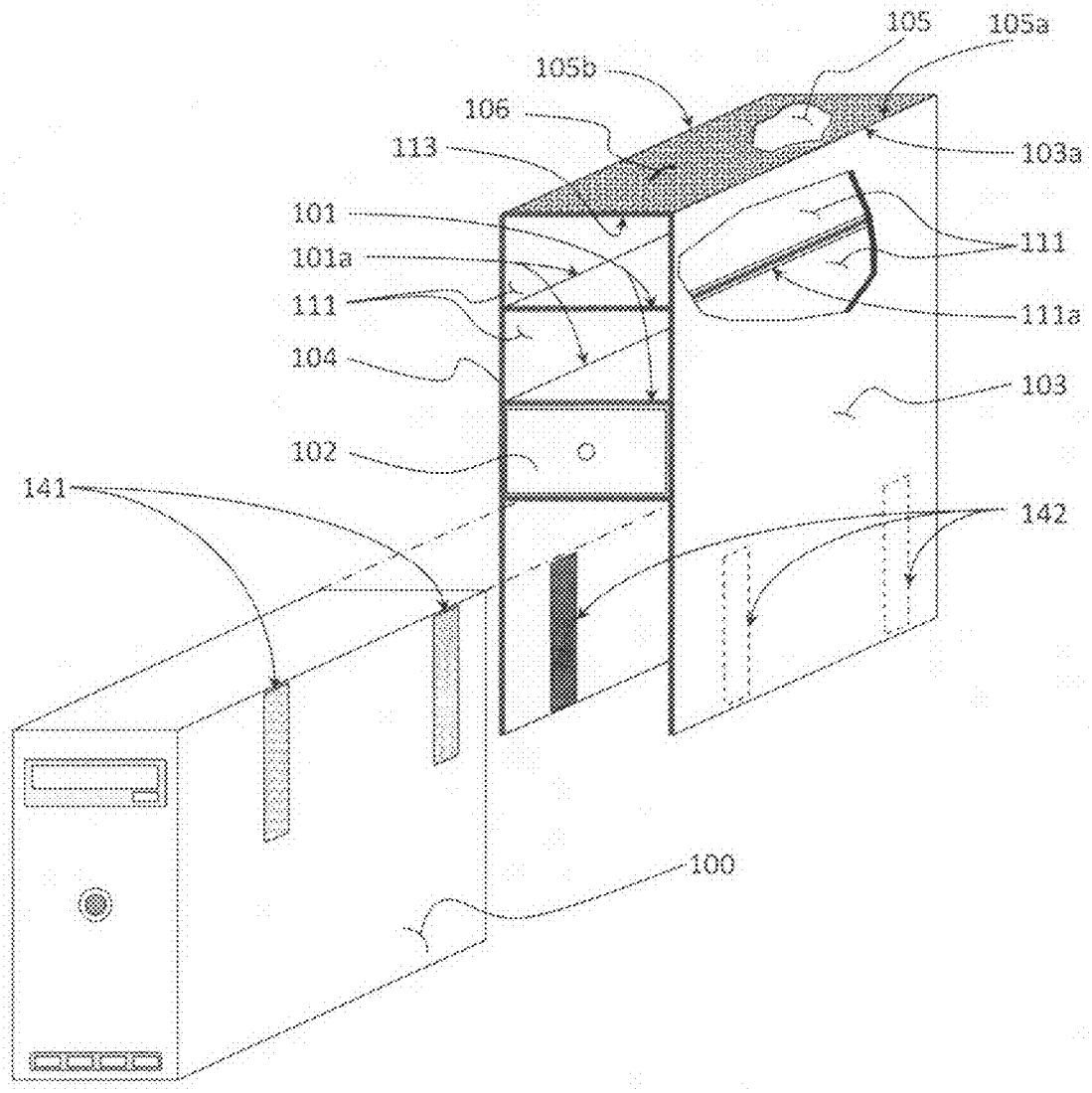
FIG. 6 is a partially cut away, perspective view of the organizer/storage system of FIG. 1, showing an embodiment of the organizer/storage system attached to the computer workstation by adaptive fasteners so that the height of the organizer/storage system may be adjusted.
Figure 7B:
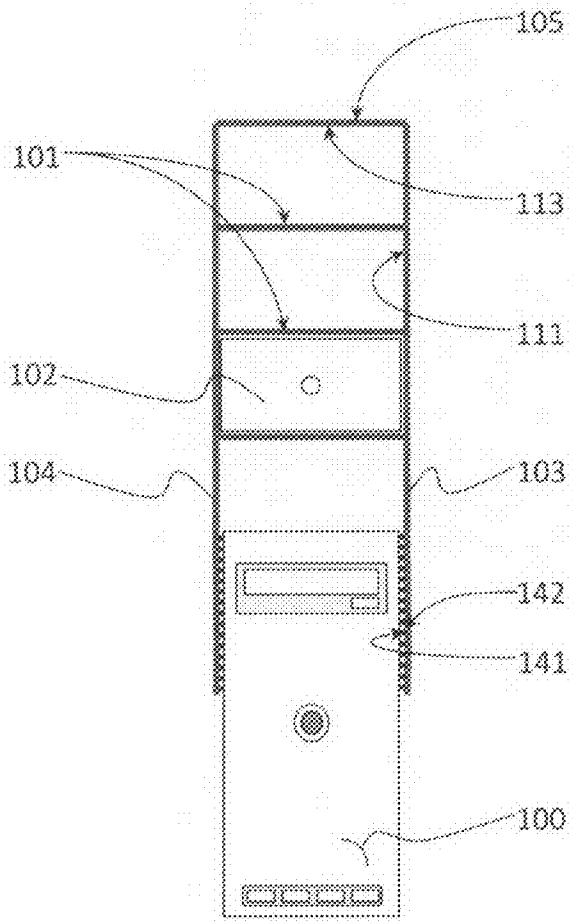
FIG. 7B is a front view of the adjustable height embodiment of the organizer/storage system of FIG. 6, showing the organizer/storage system in its raised position.
Figure 7A:
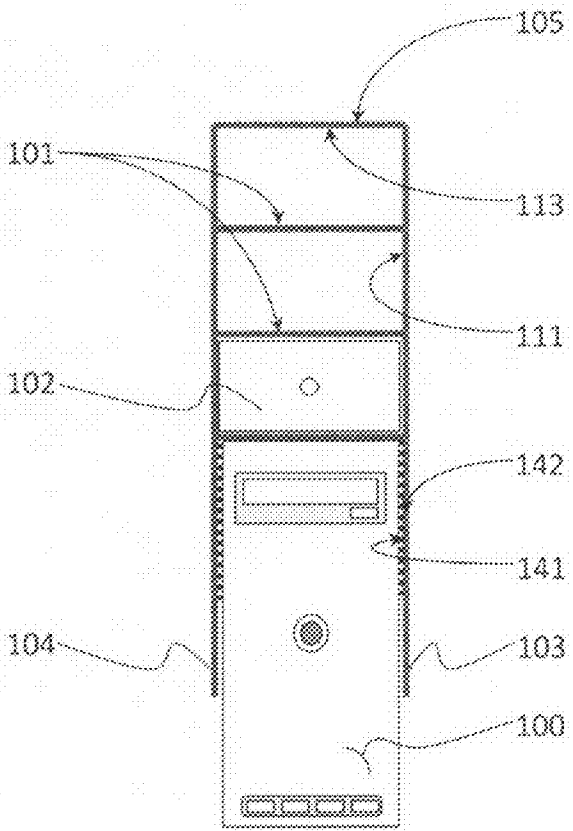
FIG. 7A is a front view of the adjustable height embodiment of the organizer/storage system of FIG. 6, shown in its lowered, basic position.

Referring to FIGS. 6, 7A, and 7B, there is shown separately an embodiment of the invention comprising an organizer/storage system attached to the computer workstation 100 by adaptive fasteners, each having an adaptive fastener first side 141 and an adaptive fastener second side 142, with the adaptive fastener first side 141 attached to the right side and the left side of the computer workstation, and the adaptive fastener second side 142 attached to the first and second side panels 103, 104, allowing the height that the organizer/storage system sits above the top of the computer workstation 100 to be varied. As shown in FIGS. 6, 7A and 7B, the adaptive fastener first side 141 and the adaptive fastener second side 142 are each made of Velcro® material, but the adjustable height organizer/storage system is equally suited to other mechanisms of adaptive fastening.

FIG. 7A depicts a front view of the adjustable height embodiment of the organizer/storage system shown in its lowered, basic position. FIG. 7B depicts a front view of the adjustable height embodiment of the organizer/storage system shown in its in its raised position. Although FIGS. 7A and 7B show the basic and raised positions, respectively, the height of the organizer/storage system may also be adjusted to any height in between the basic and raised positions. This embodiment of the invention provides an economical method for adjusting the height of the organizer/storage system, thereby maximizing the amount of storage space that can be utilized above the computer workstation 100 and permitting the height of the top of the organizer/storage system to be adjusted for the convenience of the user.

The organizer/storage system with adaptive fasteners may also be made of cardboard, utilize the interlocking closure system and the same two slide-in shelves 101 and one drawer 102 as in the preferred embodiment of the invention, but is equally applicable to other materials of construction, closure systems, and arrangements of drawers and shelves.

Figure 8:
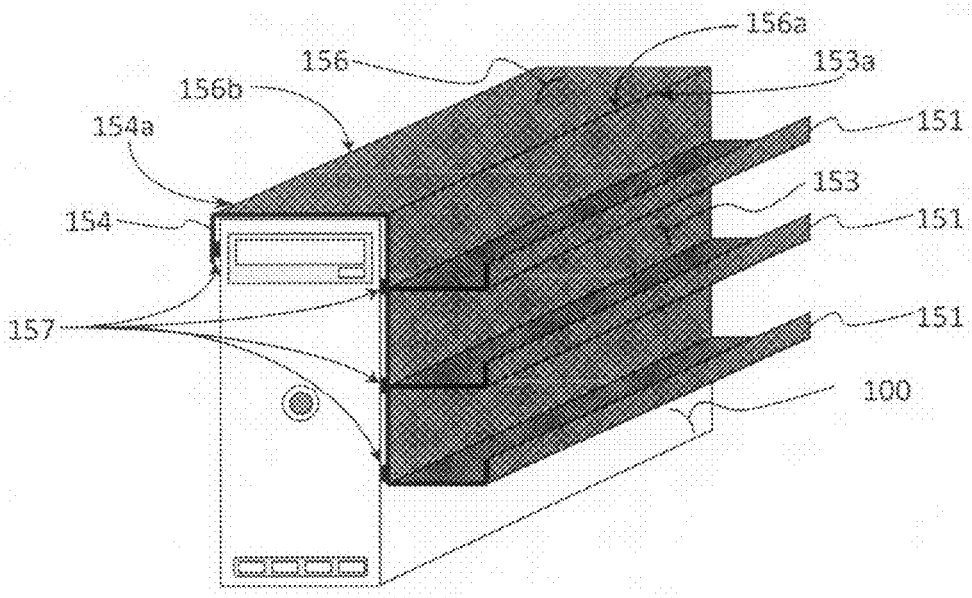
FIG. 8 is a perspective view of an additional embodiment of the invention wherein the top platform of the organizer/storage system sits directly on the top of the computer workstation and is constructed of wire mesh, including insulator pad/spacers between the organizer/storage system and the computer workstation, and showing exterior side shelves attached to the first exterior side panel only so that the second exterior side panel on the opposite side of the computer workstation may be placed directly against a desk or other item of furniture.

Referring to FIG. 8, there is shown a perspective view of an additional embodiment of the invention wherein the organizer/storage system is constructed of wire mesh and is designed to sit directly on the top of the computer workstation 100, with a top platform 156, oriented generally horizontally, having a right lateral edge 156*a* and a left lateral edge 156*b*. A first exterior side panel 153 and a second exterior side panel 154 are oriented generally vertically, are mutually parallel, and are spaced apart at a distance approximately equal to the width of the top platform 156, with an upper edge 153*a* of the first exterior side panel 153 attached to the right lateral edge 156*a* of the top platform 156, and with an upper edge 154*a* of the second side panel 154 attached to the left lateral edge 156*b* of the top platform 156. Three exterior side shelves 151, arranged in a vertically stacked and spaced apart relationship, are attached to the first exterior side panel 153. A plurality of insulator pad/spacers 157 located between the organizer/storage system and the computer workstation 100 insulate the wire mesh organizer/storage system from the metal cabinet of the computer workstation 100 and adapt the width of the organizer/storage system to the width of the computer workstation 100.

This embodiment of the invention provides more rigid shelves on which heavier objects may be placed. Additionally, because the second exterior side panel 154 is truncated near the top of the computer workstation 100, the computer workstation 100 may be located directly against a desk or another piece of furniture. The second exterior side panel 154 truncated in this manner also saves material cost and provide a lighter weight organizer/storage system.

Figure 9:
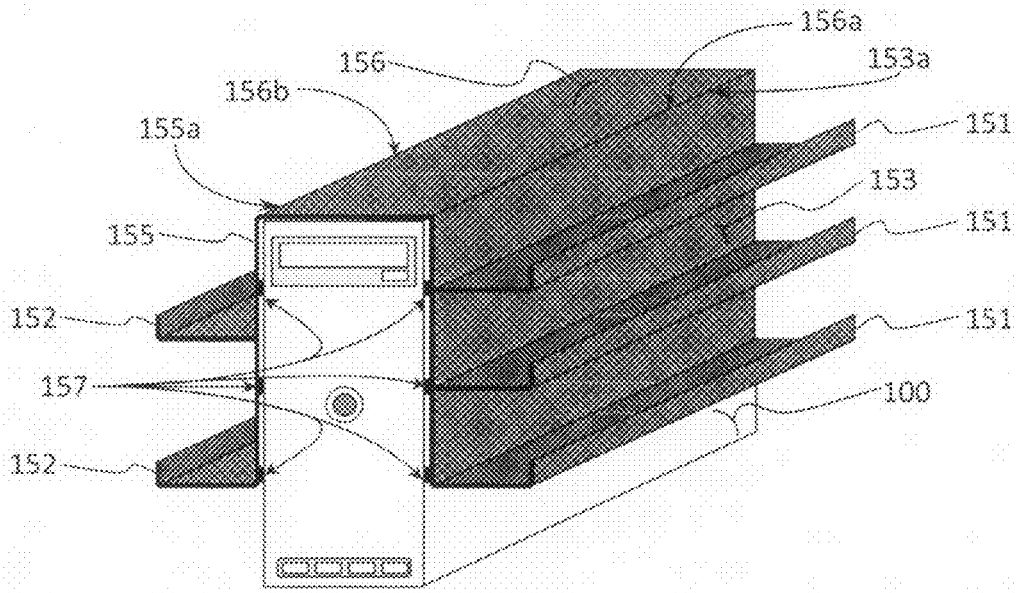
FIG. 9 is a perspective view of an embodiment of the invention wherein the top platform of the organizer/storage system sits directly on the top of the computer workstation and is constructed of wire mesh, and showing exterior side shelves attached to the first and second exterior side panels so as to provide storage on both sides of the computer workstation.

Referring to FIG. 9, there is shown a perspective view of an additional embodiment of the invention wherein the organizer/storage system is constructed of wire mesh and is designed to sit directly on the top of the computer workstation 100, with the top platform 156, oriented generally horizontally, having a right lateral edge 156*a* and a left lateral edge 156*b*. The first exterior side panel 153, having an upper edge 153*a*, and a second exterior side panel 155, having an upper edge 155*a*, are oriented generally vertically and mutually parallel, and are spaced apart at a distance approximately equal to the width of the top platform 156, with the upper edge 153*a* of the first exterior side panel 153 attached to the right lateral edge 156*a* of the top platform 156, and with the upper edge 155*a* of the second side panel 155 attached to the left lateral edge 156*b* of the top platform 156. Three exterior side shelves 151, arranged in a vertically stacked and spaced apart relationship, are attached to the first exterior side panel 153. Two exterior side shelves 152, arranged in a vertically stacked and spaced apart relationship, are attached to the second exterior side panel 155. A plurality of insulator pad/spacers 157 located between the organizer/storage system and the computer workstation 100 insulate the wire mesh organizer/storage system from the metal cabinet of the computer workstation 100 and adapt the width of the organizer/storage system to the width of the computer workstation 100.

In this embodiment of the invention, the second exterior side panel 155 extends vertically downward from the top of the computer workstation 100 to approximately the same distance from the top of the computer workstation 100 as the first exterior side panel 153. This embodiment of the invention provides for more rigid shelves for heavier objects and maximizes the storage space of the organizer/storage system.

Although the present invention has been described in considerable detail with reference to the preferred and other embodiments thereof, other versions are possible. It is to be understood that changes in details may be made as a matter of engineering choice without departing from the spirit and scope of the invention. As an example, different materials may be available for making the slide-in shelves, drawer, side panels, top platform, right and left back panels, right and left bottom panels, shelf supports, and top platform support panel such as various plastics, fiberglass, plexiglass, or sheet metals. The design and pattern of the interlocking closure system may vary. The number of shelves and drawers may also vary. The spirit and scope of the appended claims should not be limited to the description of the preferred versions contained herein.

In the Summary of the Invention and in the Detailed Description of the Invention above, in the claims below, and in the accompanying drawings, reference is made to particular features of the invention. It is to be understood that the disclosure of the invention in this specification includes all possible combinations of such particular features.

What is claimed is:

1. An apparatus for storing supplies, devices, files or other items mountable on a computer workstation having a width, a right side, a left side, and a top, the apparatus comprising:

a top platform, oriented horizontally, having a width approximately as wide as the width of a computer workstation, a right lateral edge, and a left lateral edge;

first and second side panels, oriented vertically, mutually parallel and spaced apart at a distance approximately equal to the width of the top platform, each having an upper edge, a front edge, and a rear edge, the upper edge of the first side panel attached to the top platform at its right lateral edge and the upper edge of the second side panel attached to the top platform at its left lateral edge;

a top platform support panel, oriented horizontally and designed to fit underneath the top platform, having a width approximately equal to the distance between the first and second side panels and having two lateral edges;

a plurality of slide-in shelves, oriented horizontally and arranged in a vertically stacked and spaced apart relationship and at a width designed to fit between the first and second side panels, each slide-in shelf having two lateral edges;

a plurality of pairs of shelf support panels, each shelf support panel of a pair having an upper edge, the shelf support panels of a pair oriented vertically, mutually parallel, and spaced apart at a distance approximately equal to the distance between the first and second side panels, and the pairs of shelf support panels are designed to fit inside and adjacent to the first and second side panels and are arranged in a vertically stacked relationship so that the upper edges of each pair of shelf support panels below the uppermost pair holds one slide-in shelf at its two lateral edges and is attached to the first and second side panels, the upper edges of the uppermost pair holds the top platform support panel at its two lateral edges and is attached to the first and second side panels, and the bottommost pair, having a right bottom edge and a left bottom edge, holds one slide-in shelf at its lateral edges and is attached to the first and second side panels;

a right bottom panel, oriented horizontally and having a right edge and a left edge, the right edge pivotally attached to the right bottom edge of the bottommost pair of shelf support panels;

a left bottom panel, oriented horizontally and having a right edge and a left edge, the left edge pivotally attached to the left bottom edge of the bottommost pair of shelf support panels, and the right edge adjoining the left edge of the right bottom panel;

a right back panel, oriented vertically and having a right edge and a left edge, the right edge pivotally attached to the first side panel at the rear edge; and a left back panel, having a right edge and a left edge, the left edge pivotally attached to the second side panel at the rear edge, and the right edge adjoining the left edge of the right back panel wherein the right and left back panels mate.

2. The apparatus of claim 1, wherein the right and left back panels and the right and left bottom panels each have an interlocking closure system.

3. The apparatus of claim 1, further comprising at least one conduit cutout.

4. The apparatus of claim 1, further comprising a non-slip surface adhered to the top platform.

5. The apparatus of claim 1, further comprising one or more drawers.

6. The apparatus of claim 1, wherein the top platform, first and second side panels, top platform support panel, slide-in shelves, pairs of shelf support panels, right and left back panels, and right and left bottom panels are constructed of cardboard.

7. The apparatus of claim 1, wherein the top platform, first and second side panels, top platform support panel, slide-in shelves, pairs of shelf support panels, right and left back panels, and right and left bottom panels are constructed of sheet metal.

8. The apparatus of claim 1, wherein the top platform, first and second side panels, top platform support panel, slide-in shelves, pairs of shelf support panels, right and left back panels, and right and left bottom panels are constructed of rigid plastic sheeting.

9. The apparatus of claim 1, wherein the top platform, first and second side panels, top platform support panel, slide-in shelves, pairs of shelf support panels, right and left back panels, and right and left bottom panels are constructed of rigid plastic mesh.

10. The apparatus of claim 1, wherein the top platform, first and second side panels, top platform support panel, slide-in shelves, pairs of shelf support panels, right and left back panels, and right and left bottom panels are constructed of woven wire mesh.

11. The apparatus of claim 1, wherein the side panels are attachable to the right side and the left side of the computer workstation by double-sided adhesive pads.

12. The apparatus of claim 1, wherein the first and second side panels include one or more cutouts to allow for air flow around the computer workstation.

13. The apparatus of claim 1, further comprising clips and wherein the first and second side panels extend down vertically from the top platform and truncate in use at the top of the computer workstation, and are attachable to the right side and the left side of the computer workstation by the clips.

14. The apparatus of claim 1, further comprising one or more fasteners and wherein the first and second side panels are attachable to the right side and the left side of the computer workstation by the fasteners, each fastener having a first side and a second side, the first side attachable to the right side and left side of the computer workstation and the second side attachable to the first side panel and second side panel and arranged so as to mate, allowing the distance that the apparatus extends vertically above the top of computer workstation to be varied.

15. A pattern for constructing an organizer/storage system mountable on a computer workstation having a width, the pattern comprising:

a top platform having a width approximately as wide as the width of a computer workstation, a right lateral edge, a left lateral edge, and a front edge, the front edge oriented substantially perpendicular to the right lateral edge and the left lateral edge;

first and second side panels, each having an upper edge, a front edge, and a rear edge, the upper edge of the first side panel and the right lateral edge of the top platform defining a fold line, and the upper edge of the second side panel and the left lateral edge of the top platform defining a fold line;

a top platform support panel having two lateral edges and a rear edge, the rear edge and the front edge of the top platform defining a fold line;

a plurality of slide-in shelves each having two lateral edges;

a plurality of pairs of shelf support panels, each shelf support panel of a pair having an upper edge, a rear edge, and a bottom edge, and arranged so that the rear edge of one of the support panels of a pair and a segment of the front edge of the first side panel define a fold line, and the rear edge of the other support panel of a pair and a segment of the front edge of the second side panel define a fold line, and each support panel of the pair is located equal-distant along the front edges of the respective first and second side panels;

a right bottom panel having a right edge and a left edge, the right edge and the bottom edge of one of the shelf support panels of a pair defining a fold line;

a left bottom panel having a right edge and a left edge, the left edge and the bottom edge of one of the shelf support panels of a pair defining a fold line, and the right edge designed so as to adjoin with the left edge of the right bottom panel;

a right back panel having a right edge and a left edge, the right edge and a segment of the rear edge of the first side panel defining a fold line;

a left back panel having a right edge and a left edge, the left edge and a segment of the second side panel defining a fold line, and the right edge designed so as to adjoin with the left edge of the right back panel, wherein the right and left back panels mate; wherein the pattern is formed from a single sheet of material.

16. The pattern of claim 15, wherein the right and left bottom panels and the right and left back panels each have an interlocking closure system.

17. The pattern of claim 15, wherein the right back panel and the left back panel have at least one conduit cutout.

18. The pattern of claim 15, wherein the pattern is made from cardboard.

19. The pattern of claim 15, wherein the pattern is made from sheet metal.

* * * * *